US005816876A

United States Patent [19]

Hamilton

[11] Patent Number: 5,816,876

[45] Date of Patent: Oct. 6, 1998

[54] PROCESS FOR MAKING ENHANCED SURFBOARD WITH FABRIC OUTRIGGERS AND PRODUCT BY SAME

[76] Inventor: Bill Hamilton, P.O. Box 188, Hanalei Bay, Hi. 96714

[21] Appl. No.: 848,350

[22] Filed: Apr. 29, 1997

Related U.S. Application Data

[60] Provisional application No. 60/023,789 Aug. 12, 1996.

[51] Int. Cl. [6] ..... B63B 35/79

[52] U.S. Cl. ..... 441/74; 114/357

[58] Field of Search ..... 441/65, 74; 114/355, 114/357, 39.2

[56] References Cited

U.S. PATENT DOCUMENTS 4,753,836 6/1988 Mizell ..... 441/74

5,295,883 3/1994 Moran ..... 114/357

5,514,017 5/1996 Chimiak ..... 441/74

FOREIGN PATENT DOCUMENTS 197803 3/1978 Switzerland ..... 441/74

*Primary Examiner*—Stephen Avila

*Attorney, Agent, or Firm*—Peter Jon Gluck; Manfred E. Wolff

[57] ABSTRACT

A process for producing a surfboard having rails encapsulated with a tight woven band of fabric providing up to sixty percent improvement in strength over conventional fiberglass constructions is disclosed. A product produced by said process is also taught, which allows extreme surfers to push the performance envelope and attack bigger waves, among other things.

16 Claims, 1 Drawing Sheet

FIG. 1
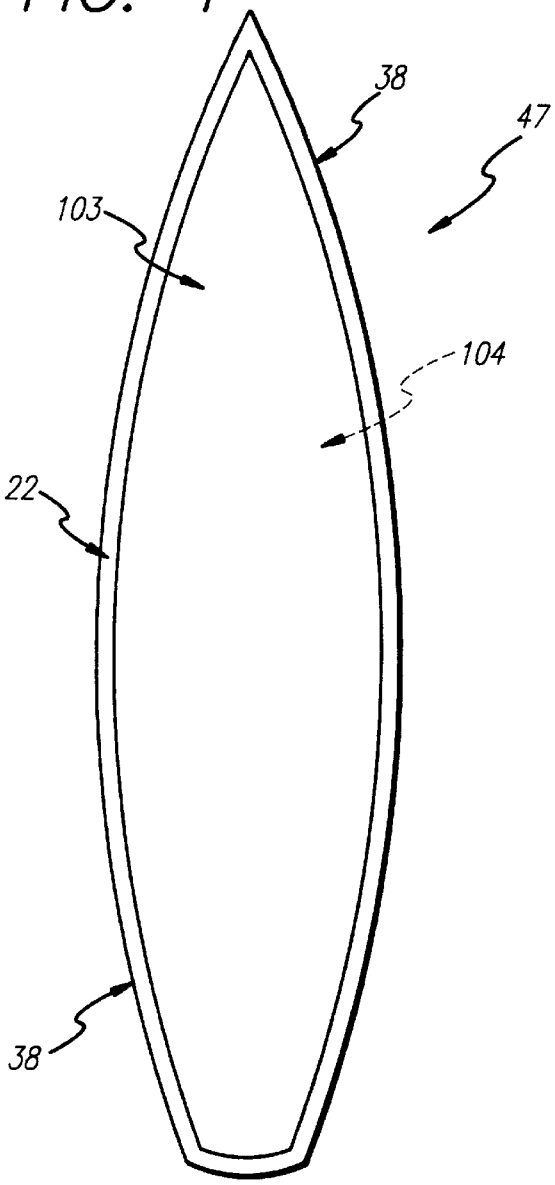
FIG. 3
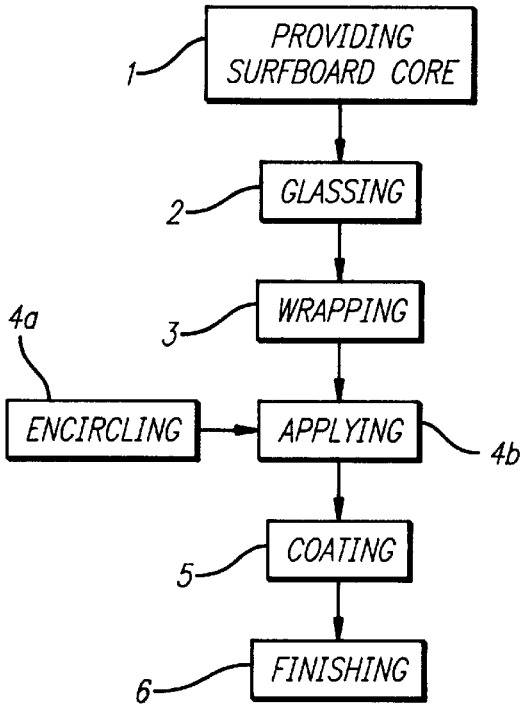
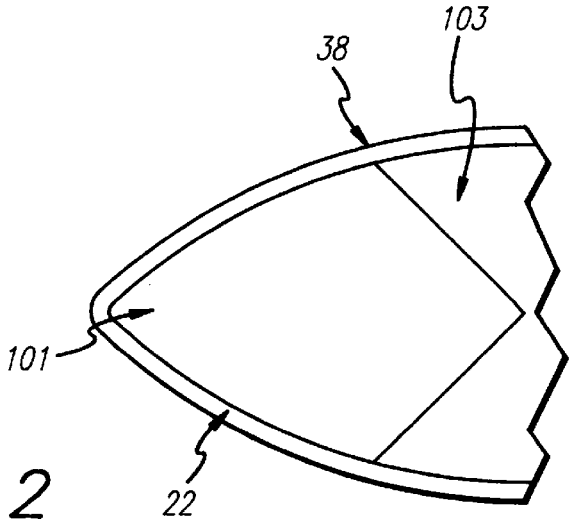
FIG. 2

PROCESS FOR MAKING ENHANCED SURFBOARD WITH FABRIC OUTRIGGERS AND PRODUCT BY SAME

BACKGROUND ART

The instant application is a conversion of provisional application for U.S. Letters Patent U.S. patent application Ser. No. 60/023,789; lodged for filing Aug. 8,12,1996 under Title 35 of the U.S. Code § 111 (b). Full rights under 35 U.S.C. §§ 119–120, and all Paris Convention priority is reserved This invention relates to surfboards. More specifically, the present invention relates to surfboards enhanced with the use of a rail reinforcement fabric layer, wherein the functional utility of the design, and the improved mechanical efficiency of surfboards incorporating said system constitutes progress in science and the useful arts. Furthermore, the present invention teaches a process for the manufacture of surfboards that incorporate said rail reinforcement fabric layer.

Surfing is an aquatic sport performed at seashores that experience a surf. The sport broadly constitutes the act of gliding toward the shore on a breaking wave. The simplest manner of surfing is called "body surfing", in which an individual allows a breaking wave to propel himself or herself bodily toward the shore, without using any means for support, guidance or flotation other than the natural buoyancy of the human body. However, the appeal of this simple form of surfing is quite limited.

A much more exciting and attractive form of surfing is called "board surfing", and this is the most widely practiced form of surfing by reason of its broader appeal. Once performed on long, cumbersome wooden boards, surfers now ride lightweight synthetic boards that allow a greater degree of maneuverability, while still providing needed support and rigidity parameters. The surfer begins at the point where the waves begin to form, then, facing shore, addles toward the beach with an oncoming wave. When the wave catches the board, the surfer stands up and glides along the wave's crest—or in the case of a large wave, in the "tube" formed by its overhead curl. Although the origins of surfing are obscure, it is clear that it developed in Hawaii, where it was popular during the 19th century. It spread to the California coast during the 1920's and became very popular with American youth in the 1960's. With lifestyles and regimens freer than those of most athletes, surfers comprise a unique sporting subcult.

Like many other sports, such as tennis, sailing, and golf, the excitement and beauty of events wherein superb surfers practice their sport has resulted in the institution of international surfing championships. Although surfing is practiced in many nations, its Mecca remains Hawaii, where the international surfing championships are held annually. And, as with other sports that employ particular types of equipment, success in surfing, particularly in competitive surfing, depends importantly on the excellence of the surfing equipment used by the surfer. Of paramount importance in this regard is the nature of the primary article of surfing equipment—the surfboard itself. As in the case of the boat used in competitive sailing, the racquet used in tournament tennis, and the outfielder's glove used in World Series baseball, every aspect of surfboard construction is important to surfing success. The performance of a surfer depends on the surfboard first of all for flotation, and further for numerous other crucial capabilities, including structural integrity under load, stability and maneuverability. The way in which a surfboard provides these functions is discussed briefly below, for the purpose of creating the setting for problems solved by the present invention.

The buoyancy of any load carrying vessel that floats in water, such as a boat, a raft, or a surfboard is explained by Archimedes' principle, which was enunciated more than 200 years before the birth of Christ. Archimedes' principle states that a body immersed in a fluid is buoyed up by a force equal to the weight of the fluid it displaces. The following discussion is focused entirely on the application of the principle to water-borne surfboards carrying a surfer, although the principle can be applied to other objects, fluids and gases as well. In determining whether a surfboard carrying a surfer will float in water, we must first have knowledge of the combined weight of the surfer and the board, the volume of the surfboard alone, and the weight of a volume of water equal to the volume of the surfboard. If the combined weight of the surfer and the surfboard is less than the weight of a volume of water equal to that of the surfboard, the surfboard will float and carry the surfer. For example, if a surfer weighs 70 Kg. (154 1bs.) and the surfboard weighs 10 Kg. (22 1bs.) the board and its surfer will float if the weight of water displaced by the surfboard is more than 80 Kg. (176 1bs.), i.e. a volume of about 80 L. (21 gal.). If the surfboard has a total volume of say, 120 L. (32 gal.) then two thirds of its volume will be submerged, displacing in the process a volume of fluid whose weight is equal to the combined weight of the surfer and the surfboard. In striving to produce a surfboard capable of carrying a surfer, it is clear that only the characteristics of the surfboard can be varied, inasmuch as the weight of the surfer is fixed by the user. Therefore, even without considering the exact details of the weights involved, it will be clear from this discussion that a relatively heavy (high-density) material, such as wood, will necessarily result in a large, heavy surfboard to provide flotation for an average surfer—this is the reason that the early wooden boards were "long (and) cumbersome" as stated in the third paragraph of this discussion. By contrast, a relatively light (low-density) material, such as cork, is capable of providing a smaller, lighter surfboard capable of providing flotation for the same individual.

However, another crucial factor that has to be considered in surfboard design is the mechanical strength and structural integrity of the board under mechanical stress. Anyone who has viewed a crashing surf will have been awed by its power. Surfboards, like boats, must have the mechanical strength and structural integrity to withstand not only the power of the sea, but also of the stresses produced by the weight and actions of the surfer as he or she rides and controls the board. Such stresses may be divided into horizontal stresses, which are stresses perpendicular to the horizontal plane of the surfboard as it floats, and lateral stresses, which are stresses perpendicular to the horizontal stresses. Such lateral and horizontal stresses may be simulated under test conditions comprising brick testing and other methods known to those in the surf arts.

Surfers and those familiar with the surfing arts call identify the various parts of a surfboard by a number of conventional terms. The leading edge of the board, which would be called the bow of a boat, is called the "nose". The trailing edge of the board, which would be called the stern of a boat, is called the "tail". As with a boat, the edges connecting the nose and the tail are called "rails". The upper surface of the board, when floating in the water, is called the "dorsal" surface, whereas the surface in contact with the water is called the "ventral" surface.

In brick testing, a surfboard is laid on two supports, or stands, in a manner such that one support is under the nose of the board, whereas the other support is under the tail of the board. One or more bricks is then placed in the middle of the dorsal surface of the board. Bricks are added one-by-one until the breaking strength of the board is reached, and the board breaks. If several boards of differing construction are subjected to this test, the number of bricks that each board will support provide a measure of the strength of the board, and of its ability to support a surfer engaged in surfing under extreme conditions.

It is obvious that a cork surfboard would not be capable of supporting many bricks under these conditions, because it is well known that cork is easily broken. For these reasons, a cork surfboard as described above, would be unsuitable for any serious use because of its limited structural integrity.

Still another crucial factor that has to be considered in surfboard construction is the resistance of the construction material to structural degradation by the action of water. Although wood and cork enjoy a robust resistance to the effects of immersion in water, the same cannot be said for other light materials capable of being formed into strong structures; for example structural cardboard. Thus, although surfboards may be made of a variety of materials, the threefold constraints of lightness, strength and resistance to water have resulted in the increasing importance of surfboards made from plastic-based materials in recent years.

A plastic is defined as any organic material with the ability to flow into a desired shape when heat and pressure are applied, and to retain the shape when they are withdrawn. A plastic is made up principally of a binder, together with plasticizers, fillers, pigments, and other additives. The binder gives a plastic its main characteristics and usually its name. Thus, polyvinyl chloride is both the name of a binder and the name of a plastic into which it is made. Binders may be natural materials, e.g. cellulose derivatives, casein or milk protein. But more commonly binders are synthetic resins. In either case, the binder materials consist of very long chainlike molecules called polymers. Cellulose derivatives are made from cellulose, a naturally occurring polymer; casein is also a naturally occurring polymer.

Plasticizers are added to a binder to increase flexibility and toughness. Fillers are added to improve particular properties, e.g. hardness or resistance to shock. Pigments are used to impart various colors. Virtually any desired color or shape an many combinations of the properties of hardness, durability, elasticity, and resistance to heat, cold and acid, can be obtained in a plastic.

There are two type of plastic: thermosets, which cannot be resoftened after being subjected to heat and pressure; and thermoplastics, which can be repeatedly softened and remolded by heat and pressure. Plastics, also called synthetic resins are polymerized, or built up, from small simple molecules called monomers. When heat and pressure are applied to a thermoplastic binder, these chainlike molecules slide past each other giving the material "plasticity". By contrast, when heat and pressure are initially applied to a thermosetting binder, the molecular chains become joined or "crosslinked", thus preventing any slippage if heat and pressure are reapplied. Thermosets are usually supplied as partially polymerized or as monomer-polymer mixtures. Cross linking is achieved during fabrication using chemicals, heat or radiation; this process is called curing or vulcanization. Important thermosets include phenol-formaldehyde, epoxy, diallyl phthalate, polyester, urea-formaldehyde, and melamine-formaldehyde, within the context of the instant teachings.

Plastic articles are commonly manufactured from thermoset plastics in which desired shapes are fashioned by molding. The monomer or partially polymerized mixture is treated with a curing agent and placed in a mold to harden. Reinforcement means can be introduced during this process, which is used for designs with intricate shapes and great variations in wall thickness. Among the plastics used for making plastic articles, including plastic surfboards, are epoxy resins, polypropylene, polyolefins, polyethylene, vinyl plastics, polycarbonates, polyacrylics, polyvinyl chloride polystyrene, phenolics, ureas, melamines, polyesters, silicones, rubbers, and polyurethanes.

Plastics may be used as such, or may be reinforced by fiberglass and other reinforcing materials in making surfboards and certain other plastic articles. Fiberglass is a thread made from glass. It is made by forcing molten glass through a kind of sieve, thereby spinning it into threads. Fiberglass is strong, durable and impervious to many caustics and to extreme temperatures. For those qualities, fabrics woven from the glass threads are widely used for industrial purposes. A wide variety of materials are made by combining fiberglass with plastic. These materials, which are rust proof, are molded into the shape required or pressed into flat sheets. Surfboards reinforced with fiberglass are made by the molding process.

Other fibers can be used as a reinforcement for plastic articles including surfboards. Of special value in this connection is polyester fiber. Polyester is a man-made fiber produced by the polymerization of the product formed when an alcohol and organic acid react. The outstanding characteristics of polyesters are their strength and dimensional stability. Rope made of polyester is used widely for marine applications, where these qualities are highly desirable. For the same reason, polyester fabric is well suited as a reinforcement for plastic articles. Still another type of plastic construction that can be used in the construction of surfboards is a plastic foam core. Such a foamed plastic can be made from polystyrene or polyurethane. Polystyrene is a widely used plastic that is a polymer of styrene. Polystyrene is a colorless, transparent thermoplastic that becomes a viscous liquid at about 185° C., (365° F.) and is resistant to acids, alkalis, oils and alcohols. It may be produced as a light foamed plastic marketed under the trade name STYROFOAM that can be produced in any of a variety of shapes.

Polystyrene foam has two important properties that make it of great potential value in surfboard construction. First, it is a thermoplastic plastic that can readily be produced in a surfboard shape. Second, it is a very low-density, light plastic because of its high air content. But a particular problem associated with the use of polystyrene is its relatively weak structural integrity. By contrast to wood or metal, an unmodified polystyrene surfboard would break easily in the brick test. As a result, an unmodified polystyrene surfboard would not be suitable for surfing because of the likelihood of surfboard failure.

A group of related and prominent concerns addressed by the instant teaching are the ease of damage to the rails of the board by rocks, shells, sand, and other hazards encountered under surfing conditions.

Still another deficiency ameliorated by the present invention is tendency of surfaces moving through water to vibrate. This impacts upon surfing as it increases the friction, or "drag" encountered by the surface with consequent slowing of the motion. This phenomenon is well Known in both hydrodynamics and aerodynamics.

Yet another problem connected with the use of white plastic surfboards is the "low-budget", inelegant appearance of these articles. The absence of any texture or color in the surface leads to this undesirable appearance. As pioneers and innovators attempt to make surfboards stronger, stiffer and longer lasting, none has approached these problems in combination with dynamic cosmetic appeal.

Each of these distinct, but significant concerns is ameliorated by the present invention as developed below and defined by the claims offered for consideration herein.

By way of background, attention is called to the following. A solution to the problem of weakness of polystyrene foam core members has been to fabricate polystyrene foam surfboard core members reinforced in the following manner. The core member is cut into two halves by means of a cut at right angles to the dorsal surface extending from the nose to the tail. A wooden beam member is then interposed between the two halves and affixed to each of them. The wooden beam member is further secured to the dorsal and ventral surfaces by means of fiberglass fabric strips along its length affixed by a plastic coating. In effect, the wooden beam member, together with the affixed fiberglass strips, forms an engineering "I-beam" which stiffens the entire board. Further reinforcement is provided by a layer of fiberglass fabric reinforcement embedded in a plastic coat covering the entire core member, Even though such surfboards have become popular consumer goods, such prior art reinforcement systems have not adequately addressed the required need for structurally enhanced surfboards as set forth below.

Variations on the known surfboard reinforcement systems have not been forthcoming, despite recent developments in the technology related to the manufacture of articles made of plastic. Thus, while it has been known to use material fabric cosmetically on surfboards, such disclosures have not adequately addressed uses of same in a structural sense. Neither have any known surfboards used fabric on anything but the deck, or bottom of the surfboards, in the manner taught by the present teachings. Likewise, in the last two decades, the present inventor, as the man of skill in the theory of the surf arts (for example, see *In Style* [magazine] Vol. 3, No. 7, p. 78 (July, 1996)) has unearthed no disclosure to date employing fabric layers in a way which provides the degree of mechanical strength, stability, and structural integrity of the subject surfboard.

By way of further background, attention is called to the following U.S. Letters Patent, which are illustrative of the state of the surfing arts: U.S. Pat. Nos. 4,521,011; 4,789,368; Des. 307,310; and, 4,932,911. Likewise, applicant directs the attention of the Office to the [*LOS ANGELES TIMES*], Section C, "The Outer Limits", pages 1, 12–13, (Jan. 29, 1997) which describes the exploits of power surfers, including the applicant's son Laird Hamilton, who encounter new challenges at Waimea Bay, Oahu, Hi.

In contradistinction to all of these surfboard modifications, the present invention embraces and finally addresses the clear need for a surfboard having fabric reinforcements which facilitate operational functionality while offering ornamental amelioration. Thus, as pioneers and innovators attempt to make surfboards better, stiffer and longer lasting, none has approached same in combination with dynamic cosmetic appeal—until the teachings of the present invention. It is respectfully submitted that other references merely define the state of the art or show the type of systems which have been used to alternately address those issues ameliorated by the teachings of the present invention. Accordingly, further discussions of these references has been omitted at this time due to the fact that they are readily distinguishable from the instant teachings to one of skill in the art.

OBJECTS AND SUMMARY OF THE INVENTION

Accordingly, several objects of the present invention are:

(a) to provide a process which overcomes the drawbacks of the prior art by fabricating onto the rails of a surfboard an encircling fabric reinforcement band;

(b) to provide a process for embedding said fabric reinforcement band in a plastic layer thereby improving the mechanical strength and structural integrity of said surfboard by up to sixty percent over conventional constructions;

(c) to provide a process for enhancing the decorative appearance of a surfboard by fabricating onto the rails an encircling fabric reinforcement band;

(d) a product by said process is also taught, which has enhanced decorative appearance and structural integrity, and which allows extreme surfers to push the performance envelope and attack bigger waves and otherwise more challenging conditions; and (e) to provide a surfboard having fabricated onto the rails encircling fabric reinforcement bands embedded in a plastic layer thereby improving the mechanical strength and structural integrity of said surfboard by up to sixty percent over conventional constructions and enhancing the decorative appearance of said surfboard.

According to a feature of the present invention there is provided a process for producing a novel enhanced surfboard with fabric outriggers comprising the steps of providing a shaped surfboard core having a top and bottom surface, glassing said shaped core with a plastic layer; wrapping a layer of at least one fabric selected from the group consisting of cotton, polyester and the like synthetics about the periphery of said shaped core, wherein said layer does not substantially cover said top or said bottom surface, coating said fabric layer with a plastic layer; and finishing said surfboard by smoothing said coated surfboard core.

According to a further feature of the present invention there is provided a process further comprising the steps of shaping a conventional surfboard core member to a predetermined shape which comprises a dorsal surface, a ventral surface, a nose, a tail, a first rail edge interposed between said nose and said tail and a second rail edge interposed between said nose and said tail. The steps still further comprise applying a first plastic layer over said core member, applying, on said first plastic layer before said first plastic layer has cured, a first reinforcement material, forcing said first reinforcement material into said uncured first plastic layer with a squeegee to embed said first reinforcement material therein, applying a second plastic layer over said still uncured first plastic layer with said first reinforcement material embedded therein, encircling said nose, said first rail edge, a portion of predetermined width of each of said dorsal and ventral surfaces contiguous thereto, and said tail of said first laminated structure with said first reinforcement band, encircling said nose, said second rail edge, a portion of predetermined width of each of said dorsal and ventral surfaces contiguous thereto, and said tail of said first laminated structure with said second reinforcement band, applying said outer plastic layer over said still uncured second plastic layer and said first and second reinforcement bands, permitting all uncured plastic to cure, and sanding and polishing said outer plastic layer, whereby said novel surfboard having enhanced structural strength and rigidity is produced.

According to yet a still further feature of the present invention there is provided by the invention a surfboard comprising a dorsal surface, a ventral surface, a nose, a tail, a first rail edge interposed between said nose and said tail, and a second rail edge interposed between said nose and said tail.

Briefly stated, A process for producing a surfboard having rails encapsulated with a tight woven band of fabric providing up to sixty percent improvement in strength over conventional fiberglass constructions is disclosed. A product produced by said process is also taught, which allows extreme surfers to push the performance envelope and attack bigger waves, among other things.

These and other objects are accomplished by the parts, constructions, arrangements, combinations and subcombinations comprising the present invention, the nature of which is set forth in the following general statement, and preferred embodiments of which—illustrative of the best modes in which applicant has contemplated applying the principles—are set forth in the following description and illustrated in the accompanying drawings, and are particularly and distinctly pointed out and set forth in the appended claims forming a part hereof Accordingly, a clear need exists for a surfboard of enhanced strength in order to be useful in surfing under both known and extreme conditions. A further need exists for a surfboard which has enhanced appearance and decorative value through the use of decorations showing Hawaiian scenes. Yet a further need exists for such a surfboard of enhanced visibility in the water. Still a further need exists for such a surfboard having rails that are resistant to damage by the action of the surf, collision with reefs, and similar navigational hazards. Even a further need exists for a process effective in providing such a surfboard. The teachings of the present invention have ameliorated these long-standing problems, and on this basis should be recognized as constituting progress in science and the useful arts.

The present invention is directed to a process for producing a novel enhanced surfboard with fabric outriggers comprising the steps of providing a shaped surfboard core having a top and bottom surface, glassing said shaped core with a plastic layer; wrapping a layer of at least one fabric selected from the group consisting of cotton, polyester and the like synthetics about the periphery of said shaped core, wherein said layer does not substantially cover said top or said bottom surface, coating said fabric layer with a plastic layer; and finishing said surfboard by smoothing said coated surfboard core. The process can further comprise the steps of shaping a conventional surfboard core member to a predetermined shape which comprises a dorsal surface, a ventral surface, a nose, a tail, a first rail edge interposed between said nose and said tail and a second rail edge interposed between said nose and said tail. The steps further comprise applying a first plastic layer over said core member, applying, on said first plastic layer before said first plastic layer has cured, a first reinforcement material, forcing said first reinforcement material into said uncured first plastic layer with a squeegee to embed said first reinforcement material therein, applying a second plastic layer over said still uncured first plastic layer with said first reinforcement material embedded therein, encircling said nose, said first rail edge, a portion of predetermined width of each of said dorsal and ventral surfaces contiguous thereto, and said tail of said first laminated structure with said first reinforcement band, encircling said nose, said second rail edge, a portion of predetermined width of each of said dorsal and ventral surfaces contiguous thereto, and said tail of said first laminated structure with said second reinforcement band, applying said outer plastic layer over said still uncured second plastic layer and said first and second reinforcement bands, permitting all uncured plastic to cure, and sanding and polishing said outer plastic layer, whereby said novel surfboard having enhanced structural strength and rigidity is produced.

The process can involve conditions wherein said first reinforcement material, said first reinforcement band, and said second reinforcement band are each independently made from a woven fabric having warp stands and weft strands; and wherein the respective warp strands and weft strands comprise a plurality of fibers selected from the group comprising cotton fibers, silk fibers, rayon fibers, polypropylene fibers, linen fibers, hemp fibers, polyester fibers, and polyamide fibers, Likewise, the process can involve conditions wherein said first plastic layer, said second plastic layer and said outer plastic layer are each independently selected from the group comprising phenol-formaldehyde, epoxy, diallyl phthalate, unsaturated polyesters, urea-formaldehyde, and melamine-formaldehyde and wherein said first plastic layer, said second plastic layer and said outer plastic layer are unsaturated polyesters. The process wherein said first reinforcement material is made of woven fabric made of strands or threads consisting of glass fibers, wherein said first reinforcement band encircles said nose, said first rail edge, a strip at least about 3.8 cm (1.5 in.) in width of each of said dorsal and ventral surfaces contiguous thereto, and said tail of said first laminated structure; and said second reinforcement band encircles said nose, said second rail edge, a strip at least about 3.8 cm. (1.5 in.) in width of each of said dorsal and ventral surfaces contiguous thereto, and said tail of said first laminated structure, and wherein said first reinforcement band and said second reinforcement band are made from a woven fabric made of polyester is preferred.

Also provided is product as produced by the process of the invention.

Further provided by the invention is a surfboard comprising a dorsal surface, a ventral surface, a nose, a tail, a first rail edge interposed between said nose and said tail, and a second rail edge interposed between said nose and said tail. Said surfboard further comprises a conventional core member having a predetermined shape, a first plastic layer having a first reinforcement material embedded therein, whereby said first plastic layer and said first reinforcement material form a reinforced plastic layer, said reinforced plastic layer encapsulating said core member and forming with said core member a first laminated structure. A second plastic layer has a first reinforcement band embedded therein; whereby said first reinforced band encircles said nose, said first rail edge and a portion of said dorsal surface and said ventral surface contiguous with said first rail edge, and said tail of said first laminated structure thereby encapsulating said first rail edge. Said second plastic layer has a second reinforcement band embedded therein; whereby said second reinforced band encircles said nose, said second rail edge and a portion of said dorsal surface and said ventral surface contiguous with said second rail edge, and said tail of said first laminated structure thereby encapsulating said second rail edge. A finish resin layer encapsulates said first laminated structure and said second plastic layer, forming with said second plastic layer a second laminated structure, whereby said first reinforcement band and said second reinforcement band provide for substantial enhancement of the structural strength, stiffness, and durability of said surfboard.

Said first plastic layer, said second plastic layer, and said third plastic layer may each independently be made from catalyzed polyester resin or catalyzed epoxy resin; and said first reinforcement material, said first reinforcement band, and said second reinforcement band may each independently be made from a woven fabric having warp stands and weft strands, wherein said warp strands and weft strands comprise a plurality of fibers selected from the group comprising cotton fibers, silk fibers, rayon fibers, polypropylene fibers, linen fibers, hemp fibers, polyester fibers, and polyamide fibers, A preferred embodiment of a surfboard according to the present invention has a core member made of rigid polystyrene foam, said first reinforcement material is woven fiberglass cloth, said first plastic layer, said second plastic layer, and said third plastic layer are made from catalyzed polyester resin. In the preferred surfboard, a first reinforcement band encircles said nose, said first rail edge, a strip at least about 3.8 cm (1.5 in.) in width of each of said dorsal and ventral surfaces contiguous thereto, and said tail of said first laminated structure; said second reinforcement band encircles said nose, said second rail edge, a strip at least about 3.8 cm. (1.5 in.) in width of each of said dorsal and ventral surfaces contiguous thereto, and said tail of said first laminated structure. In the preferred surfboard, said first reinforcement band and said second reinforcement band are each made from a woven fabric having warp stands and weft strands which comprise a plurality of polyester fibers; and said first reinforcement band and said second reinforcement band are each made from a patterned multicolor fabric showing a Hawaiian scene, whereby the visibility of said surfboard in the water is enhanced.

In sum, the above, and other objects, features and objectives of the present invention, shall become apparent with the following description whether in conjunction with the accompanying drawings, in which like reference numerical designating indicators designate the same elements.

BRIEF EXPLANATION OF THE DRAWINGS

FIG. 1 is a plan view of the surfboard having fabricated onto the rails encircling fabric reinforcement bands embedded in a plastic layer according to the present invention.

FIG. 2 is a partial cut away view of a first half of the surfboard having fabricated onto the rails encircling fabric reinforcement bands embedded in a plastic layer according to the present invention.

FIG. 3 is a schematic diagram illustrating the steps of the process according to the present invention.

DETAILED DESCRIPTION OF THE PREFERRED EMBODIMENTS

Referring now to FIG. 1, board 38 contains a surfboard core having the same general configuration as any known surfboard, typically comprising a fiberglass or related material construction. In the embodiment illustrated, the subject surfboard core was crafted by BILL HAMILTON CUSTOM DESIGNS OF Hanalei Bay, Kauai, Hi. 96714. Those having a modicum of skill in the art will readily understand that boards by any leading manufacturer may be appropriately substituted.

The novel enhanced surfboard 47 of the present invention includes dorsal side 103 and ventral side 104 (underneath the two dimensional board shown). A peripheral rail portion 38 defines the border between the dorsal side 103 and the ventral side 104 (not shown). Fabric 22 in this embodiment is a tightly woven fabric band 22 disposed upon rail portion 38 and extending at least about three and eight-tenths centimeters (about one and one-half inches) from the ventral side 104 rail portion 38 border onto the dorsal side. Likewise, those skilled in the art would know that the fabric, which in this embodiment is at least one material selected from the group consisting of cotton, silk, rayon, polypropylene, linen, polyester, and the like synthetics may also include related materials having the desired structural characteristics. Surfboard 47, is made by having the fabric 22 fabricated onto the rails 38 and the encircling fabric reinforcement 22 are embedded in a plastic layer according to the present invention.

Referring now to FIG. 2, a view of the nose portion of an alternate preferred embodiment is shown. This view shows peripheral rail portion 38 defining the border between the dorsal side 103 and the ventral side 104 (not shown). Fabric 22 in this embodiment is a tightly woven fabric band 22 disposed upon rail portion 38 and extending at least about three and eight-tenths centimeters (about one and one-half inches) from the ventral side 104 rail portion 38 border onto the dorsal side. Fabric layer 22, furhter includes nose swatch 101, which is affixed to the surfboard of the present invention as discussed below. Referring now to FIG. 3, a flowchart schematically represents the steps involved in creating the surfboard 47, of the present invention. The general steps of this process include providing a shaped surfboard core 1, having a top and bottom surface defined by a peripheral rail surface disposed therebetween, which rail surface gradually decreases in width from a central point equidistant from each of a nose and a tail portion of said shaped core; glassing said shaped core with a plastic layer 2; wrapping a layer of at least one fabric selected from the group consisting of cotton, polyester and the like synthetics about the peripheral rail section of said shaped core 3, wherein said layer extends to cover the entire peripheral rail section but does not substantially cover said top or said bottom surface, this step is further divided into encircling the surfboard with the desired fabric layer 4*a*; and applying an unsaturated polyester covering 4*b*. Coating 5, of the entire surfboard, is the next step and finishing 6, completes the process. The coating step 5 further comprises coating both said fabric layer and the entire top and bottom surface of said core with a plastic layer to produce a surfboard product and the step of 6, includes finishing said surfboard by smoothing said coated surfboard product.

By encapsulating the surfboard rails with a resin impregnated fabric band, the present inventor has discovered that impact strength, as for example when the surfboard contacts a reef, is increased in much the same way as a bumper functions on a car or boat. Penetration into the foam core of the surfboard by the impacting reef or object is greatly decreased by the added exterior shield of resin impregnated woven fabric.

Very unexpectedly, by encapsulating the surfboard rails with a resin impregnated fabric band, the present inventor has discovered that lateral and horizontal stresses simulated under test conditions have been resisted approximately 60 percent more than usual. Such testing has included brick testing and other methods known to those in the surf arts. Such a difference is having a major impact on surfboard competitions, and represents a major advance in the surfboard art.

The physical and theoretical basis for the dramatically improved surfboard strengthening produced by encapsulation of the surfboard rails in a plastic impregnated woven fabric band is not known with certainty by the inventor. It is pertinent to state that there is a major change in the failure mode of an ordinary surfboard and the surfboard of the present invention. When an ordinary surfboard fails in the brick test, the reinforcing fibers break and the board breaks into two halves, much as a wooden plank breaks under similar circumstances. By contrast, when the surfboard of the present invention fails under greater load in the same test, the board fractures catastrophically, and appears to "implode" as it fractures in numerous places.

The inventor's putative mechanism postulates that the dramatic, unexpected major enhancement in brick test performance by the surfboard of the invention is due to the formation of an engineering structural beam on each rail of the boat by the encapsulation of the surfboard rails of the present invention. As has been pointed out earlier, conventional surfboards are stiffened by a central wooden beam affixed to fiberglass strips. In the case of the surfboard of the present invention, the encapsulation of the rails of the surfboard appears to provide two additional beams comprising the reinforced rails themselves. These beams are formed by the conventional surfboard core rails and the affixed encircling plastic bands.

The strength of an engineering beam is known to derive from the resistance of the loaded side of the beam to compression, and the resistance of the unloaded side of the beam to elongation, said compression and elongation being caused by the bending of the beam under load. In the case of the hypothesized surfboard rail beams, it is reasonable to believe that the encapsulated woven fabric will provide considerable resistance to elongation, and could, in the inventor's opinion, be responsible for the dramatic and unexpected increase in surfboard strength.

On this basis, the instant invention should be recognized as constituting progress in science and the useful arts, as providing rigidity without concomitant loss in maneuverability and solving the problems enumerated above.

In the foregoing description, certain terms have been used for brevity, clearness and understanding, but no unnecessary limitations are to be implied therefrom beyond the requirements of the prior art, because such words are used for descriptive purposes herein and are intended to be broadly construed.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims. For example, the product can have other shapes, or could make use of other fabrics or plastic coatings. Thus the scope of the invention should be determined by the appended claims and their legal equivalents, rather than by the examples given.

What is claimed is:

1. A surfboard with enhanced strength; and structural rigidity, comprising, in combination:

(a) a surfboard having dorsal and ventral surfaces; and (b) means for encapsulating the rails of said surfboard; wherein said means provides for substantial enhancement of the structural characteristics of said surfboard;

said surfboard further comprising:

(a) a dorsal surface;

(b) a ventral surface;

(c) a nose;

(d) a tail;

(e) a first rail edge interposed between said nose and said tail; and (f) a second rail edge interposed between said nose and said tail;

(g) a conventional core member having a predetermined shape;

(h) a first plastic layer having a first reinforcement material embedded therein, whereby said first plastic layer and said reinforcement material form a reinforced plastic layer, said reinforced plastic layer encapsulating said core member and forming with said core member a first laminated structure;

(i) a second plastic layer having a first reinforcement band embedded therein; whereby said first reinforced band encircles said nose, said first rail edge and a portion of said dorsal surface and said ventral surface contiguous with said first rail edge, and said tail of said first laminated structure thereby encapsulating said second rail edge;

(j) said second plastic layer having a second reinforcement band embedded therein; whereby said second reinforced band encircles said nose, said second rail edge and a portion of said dorsal surface and said ventral surface contiguous with said second rail edge, and tail of said first laminated structure thereby encapsulating said rail edge;

(k) a finish resin layer encapsulating said first laminated structure and said second plastic layer, and forming with said second plastic layer a second laminated structure;

whereby said first reinforcement band and said second reinforcement band provide for substantial enhancement of the structural strength, stiffness and durability of said surfboard;

wherein said first plastic layer, said second plastic layer, and said third plastic layer are each independently made from catalyzed polyester resin or catalyzed epoxy resin; and wherein said first reinforcement material, said first reinforcement band, and said second reinforcement band are each made independently from a woven fabric having warp strands and weft strands; and wherein said warp strands and weft strands comprises a plurality of fibers selected from the group comprising cotton fibers, silk fibers, rayon fibers, polypropylene fibers, linen fibers, hemp fibers, polyester fibers and polyamide fibers.

2. A process effective for creating a novel surfboard having enhanced structural strength and rigidity, said process comprising the steps of:

(a) shaping a conventional surfboard core member to a predetermined shape; said shape comprising:

(i) a dorsal surface;

(ii) a ventral surface;

(iii) a nose;

(iv) a tail;

(v) a first rail edge interposed between said nose and said tail; and (vi) a second rail edge interposed between said nose and said tail;

(b) applying a first plastic layer over said core member;

(c) applying, on said first plastic layer before said first plastic layer has cured, a first reinforcement material;

(d) forcing said first reinforcement material into said uncured first plastic layer with a squeegee to embed said first reinforcement material therein;

(e) applying a second plastic layer over said still uncured first plastic layer with said first reinforcement material embedded therein;

(f) encircling said nose, said first rail edge, a portion of predetermined width of each of said dorsal and ventral surfaces contiguous thereto, and said tail of said first laminated structure with said first reinforcement band;

(g) encircling said nose, said second rail edge, a portion of predetermined width of each of said dorsal and ventral surfaces contiguous thereto, and said tail of said first laminated structure with said second reinforcement band;

(h) applying said outer plastic layer over said still uncured second plastic layer and said first and second reinforcement bands;

i) permitting all uncured plastic to cure; and j) sanding and polishing said outer plastic layer, whereby said novel surfboard having enhanced structural strength and rigidity is produced.

3. The process as recited in claim 2, wherein said first reinforcement material, said first reinforcement band, and said second reinforcement band are each independently made from a woven fabric having warp stands and weft strands; and wherein the respective warp strands and weft strands comprise a plurality of fibers selected from the group consisting of cotton fibers, silk fibers, rayon fibers, polypropylene fibers, linen fibers, hemp fibers, polyester fibers, and polyamide fibers.

4. The process as recited in claim 3, wherein said first plastic layer, said second plastic layer and said outer plastic layer are each independently selected from the group comprising phenolformaldehyde, epoxy, diallyl phthalate, unsaturated polyesters, urea-formaldehyde, and melamine-formaldehyde.

5. The process as recited in claim 2, wherein said first plastic layer, said second plastic layer and said outer plastic layer are unsaturated polyesters.

6. The process as recited in claim 2, wherein said first reinforcement material is made of woven fabric material consisting of at least one of strands and threads consisting essentially of glass fibers.

7. The process as recited in claim 2, wherein said first reinforcement band encircles said nose, said first rail edge, a strip at least about 3.8 cm (1.5 in.) in width of each of said dorsal and ventral surfaces contiguous thereto, and said tail of said first laminated structure; and said second reinforcement band encircles said nose, said second rail edge, a strip at least about 3.8 cm. (1.5 in.) in width of each of said dorsal and ventral surfaces contiguous thereto, and said tail of said first laminated structure.

8. The process as recited in claim 2 wherein said first reinforcement band and said second reinforcement band are made from a woven fabric made of polyester.

9. Product, produced by the process defined in claim 2.

10. Product, produced by the process defined in claim 3.

11. Product, produced by the process defined in claim 4.

12. Product, produced by the process defined in claim 5.

13. Product, produced by the process defined in claim 6.

14. Product, produced by the process defined in claim 7.

15. Product, produced by the process defined in claim 8.

16. A surfboard with enhanced strength; and structural rigidity, comprising, in combination:

(a) surfboard having dorsal and ventral surfaces; and (b) means for encapsulating the rails of said surfboard; wherein said means provides for substantial enhancement of the structural characteristics of said surfboard;

said surfboard further comprising:

(a) a dorsal surface;

(b) a ventral surface;

(c) a nose;

(d) a tail;

(e) a first rail edge interposed between said nose and said tail; and (f) a second rail edge interposed between said nose and said tail;

(g) a conventional core member having a predetermined shape;

(h) a first plastic layer having a first reinforcement material embedded therein, whereby said first plastic layer and said reinforcement material form a reinforced plastic layer, said reinforced plastic layer encapsulating said core member and forming with said core member a first laminated structure;

(i) a second plastic layer having a first reinforcement band embedded therein; whereby said first reinforced band encircles said nose, said first rail edge and a portion of said dorsal surface and said ventral surface contiguous with said first rail edge, and said tail of said first laminated structure thereby encapsulating said second rail edge;

(j) said second plastic layer having a second reinforcement band embedded therein; whereby said second reinforced band encircles said nose, said second rail edge and a portion of said dorsal surface and said ventral surface contiguous with said second rail edge, and said tail of said first laminated structure thereby encapsulating said rail edge;

(k) a finish resin layer encapsulating said first laminated structure and said second plastic layer, and forming with said second plastic layer a second laminated structure;

whereby said first reinforcement band and said second reinforcement band provide for substantial enhancement of the structural strength, stiffness and durability of said surfboard;

wherein said first plastic layer, said second plastic layer, and said third plastic layer are each independently made from catalyzed polyester resin or catalyzed epoxy resin; and wherein said first reinforcement material, said first reinforcement band, and said second reinforcement band are each made independently from a woven fabric having warp strands and weft strands; and wherein said warp strands and weft strands comprise a plurality of fibers selected from the group comprising cotton fibers, silk fibers, rayon fibers, polypropylene fibers, linen fibers, hemp fibers, polyester fibers and polyamide fibers;

wherein:

(a) said core member is made of rigid polystyrene foam;

(b) said reinforcement material is woven fiberglass cloth;

(c) said first plastic layer, said second plastic layer, and said third plastic layer are made from catalyzed polyester resin;

(d) said first reinforcement band encircles said nose, said first rail edge, a strip at least about 3.8 cm (1.5 in) in width of each of said dorsal and ventral surfaces contiguous thereto, and said tail of said first laminated structure;

(e) said second reinforcement band encircles said nose, said second rail edge, a strip at least about 3.8 cm (1.5 in) in width of each of said dorsal and ventral surfaces contiguous thereto, and said tail of said first laminated structure;

(f) said first reinforcement band and said second reinforcement band are each made from a woven fabric having warp strands and weft strands which comprise a plurality of polyester fibers; and (g) wherein said first reinforcement band and said second reinforcement band are each made from a patterned multicolor fabric showing a Hawaiian scene, whereby the visibility of said surfboard in the water is enhanced.

* * * * *